US008991293B1

(12) United States Patent
Karfiol et al.

(10) Patent No.: US 8,991,293 B1
(45) Date of Patent: Mar. 31, 2015

(54) PISTOL HAVING A BARREL WITH SYNCHRONIZED CAMS

(71) Applicant: Kimber IP, LLC, Yonkers, NY (US)

(72) Inventors: Yury Karfiol, Brooklyn, NY (US); John Goliber, Leonia, NJ (US)

(73) Assignee: Kimber IP, LLC, Yonkers, NY (US)

( * ) Notice: Subject to any disclaimer, the term of this patent is extended or adjusted under 35 U.S.C. 154(b) by 0 days.

(21) Appl. No.: 14/091,733

(22) Filed: Nov. 27, 2013

Related U.S. Application Data

(63) Continuation of application No. 12/987,317, filed on Jan. 10, 2011, now Pat. No. 8,621,976.

(51) Int. Cl.
*F41A 21/02* (2006.01)

(52) U.S. Cl.
CPC ..... *F41A 21/02* (2013.01)
USPC ..... 89/14.05; 42/76.01

(58) Field of Classification Search
CPC ..... F41A 21/24; F41A 21/22; F41A 21/02
USPC ..... 89/173, 14.05; 42/76.01
See application file for complete search history.

(56) References Cited

U.S. PATENT DOCUMENTS 618,036 A * 1/1899 Hurst ..... 89/15
785,975 A * 3/1905 McClean ..... 89/14.3
3,158,064 A 11/1964 Charron
3,738,044 A 6/1973 Robinson
3,756,121 A 9/1973 Roy
4,361,975 A 12/1982 Wilhelm
5,734,120 A 3/1998 Besselink
6,318,231 B1 11/2001 Kart
8,453,555 B1 6/2013 Karfiol et al.
8,621,976 B1 * 1/2014 Karfiol et al. ..... 89/163

FOREIGN PATENT DOCUMENTS

DE 2 149 774 * 4/1973
GB 9465 * 0/1912

* cited by examiner

*Primary Examiner* — Stephen M Johnson
(74) *Attorney, Agent, or Firm* — Caesar, Rivise, Bernstein, Cohen & Pokotilow, Ltd.

(57) ABSTRACT

A semi-automatic pistol is provided having a barrel, a frame and a slide. The slide is adapted for linear motion along the frame during a firing sequence and has a forward end and a block end. The forward end has an upper cam follower surface and a lower cam follower surface on the inside surface adjacent to the barrel. The barrel has a ramp cam surface adjacent to the chamber end of the barrel to effect locking and unlocking of the barrel relative to the slide during the firing sequence, a bottom cam surface and a top cam surface. The bottom cam surface and the top cam surface extend from the front end toward the chamber end of the barrel and each have undulating surfaces that moves against the lower cam follower surfaces of the slide to cause oscillation of the barrel while the slide moves during the firing sequence.

1 Claim, 11 Drawing Sheets

PISTOL HAVING A BARREL WITH SYNCHRONIZED CAMS

CROSS REFERENCE TO RELATED APPLICATION

This application is a continuation application of application Ser. No. 12/987,317 filed on Jan. 10, 2011, now U.S. Pat. No. 8,621,976, and whose entire disclosure is incorporated by reference herein.

BACKGROUND OF THE INVENTION

The present invention is directed to semi-automatic pistols. More particularly, the present invention is directed to semi-automatic pistols having improved feeding and extraction of ammunition and improved jamming avoidance.

It is highly desirable for semi-automatic pistols to have precise controlled timing of all the elements of its firing cycle. Such a design would provide improved feeding and extraction of ammunition, avoidance of jamming, particularly between ammunition and the pistol's barrel during a firing sequence, and provide improved case extraction and round in-feeding during a firing sequence.

BRIEF SUMMARY OF THE INVENTION

In a preferred embodiment of the present invention, a semi-automatic pistol is provided which includes a barrel having a bore, a chamber, an outside surface, a front end and a chamber end, a frame, and a slide adapted for linear motion along the frame during a firing sequence. The slide has a forward end and a block end, the forward end having an upper cam follower surface on an inside surface adjacent to the barrel and a lower cam follower surface on the inside surface adjacent to the barrel. The barrel has three cam surfaces, including a ramp cam surface adjacent to the chamber end of the barrel to effect locking and unlocking of the barrel relative to the slide during the firing sequence, a bottom cam surface and a top cam surface. The bottom cam surface and the top cam surface each are on the outside surface of the barrel and extend from the front end toward the chamber end of the barrel. The bottom cam surface has an undulating surface that moves against the lower cam follower surface of the slide and the top cam surface has an undulating surface that moves against the upper cam follower surface of the slide to cause oscillation of the barrel while the slide moves from a battery position to a fully retracted position and back to the battery position during the firing sequence.

Preferably, movement of a trigger of the pistol to a firing position causes the slide to retract relative to the frame and a ramp cam follower on the frame to move against the ramp cam surface to cause the chamber end of the barrel to move downward relative to the frame to release the barrel from fixed engagement with the slide to allow the slide to begin movement to a retracted position.

A barrel for a semi-automatic pistol is also provided which includes a bore, an outside surface, a front end and a chamber end. The barrel has a bottom cam surface and a top cam surface. The bottom cam surface and the top cam surface are each on the outside surface of the barrel and extend from the front end toward the chamber end of the barrel. The bottom cam surface and said top cam surface each have an undulating surface to cause oscillation of the barrel while the slide moves from a battery position to a fully retracted position and back to the battery position during a firing sequence. The barrel may also include a ramp cam surface adjacent to the chamber end of the barrel to effect locking and unlocking of the barrel relative to a slide of the pistol during a firing sequence.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
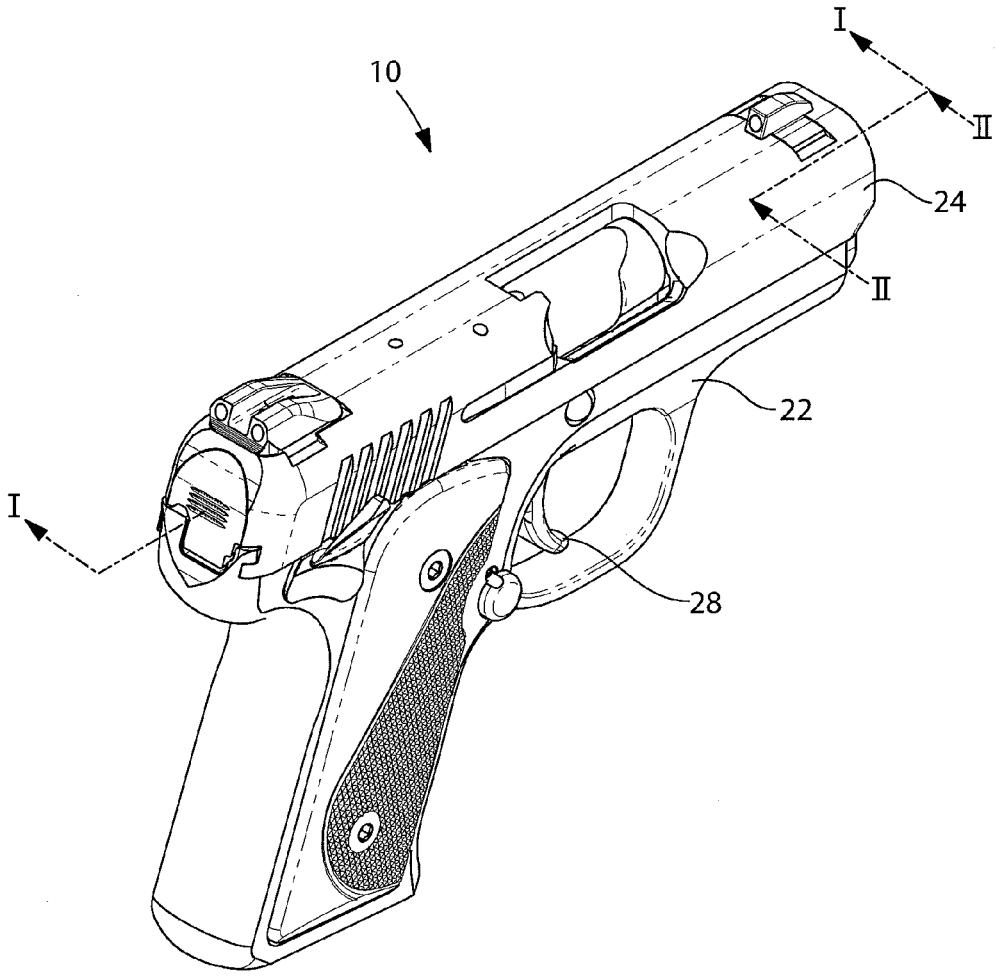
FIG. 1 is an isometric view of a pistol having a barrel with synchronized cams in accordance with a preferred embodiment of the present invention.
Figure 2:
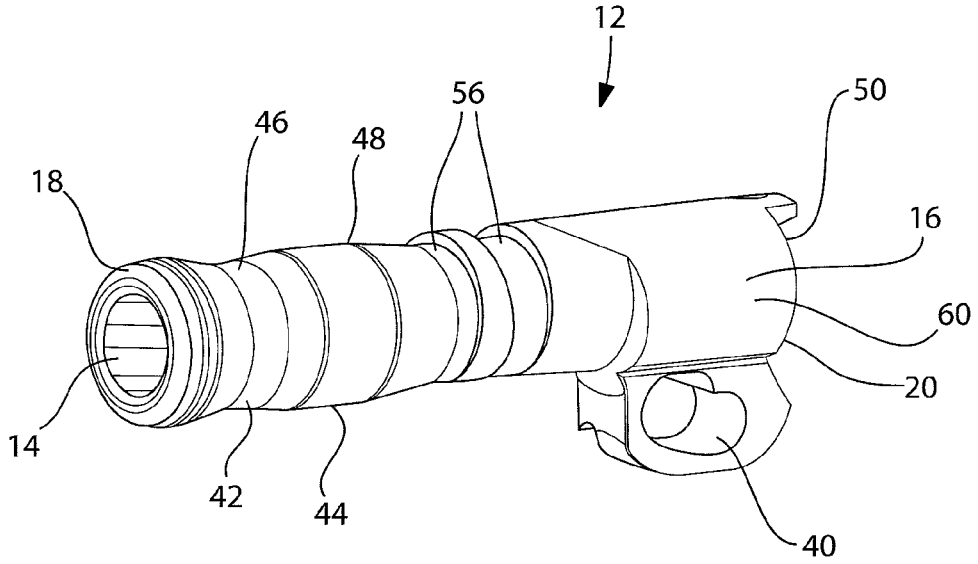
FIG. 2 is a left side isometric view of the barrel of the pistol of FIG. 1.
Figure 3:
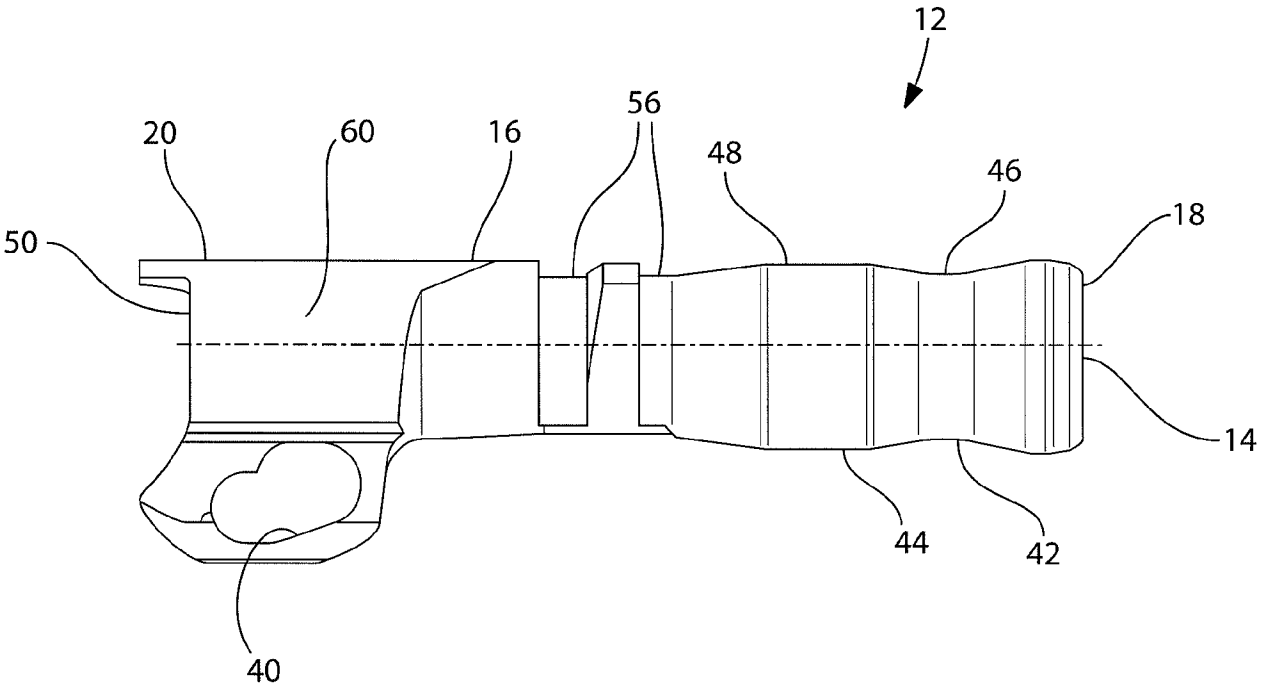
FIG. 3 is a side, elevation view of the barrel of FIG. 2.
Figure 4:
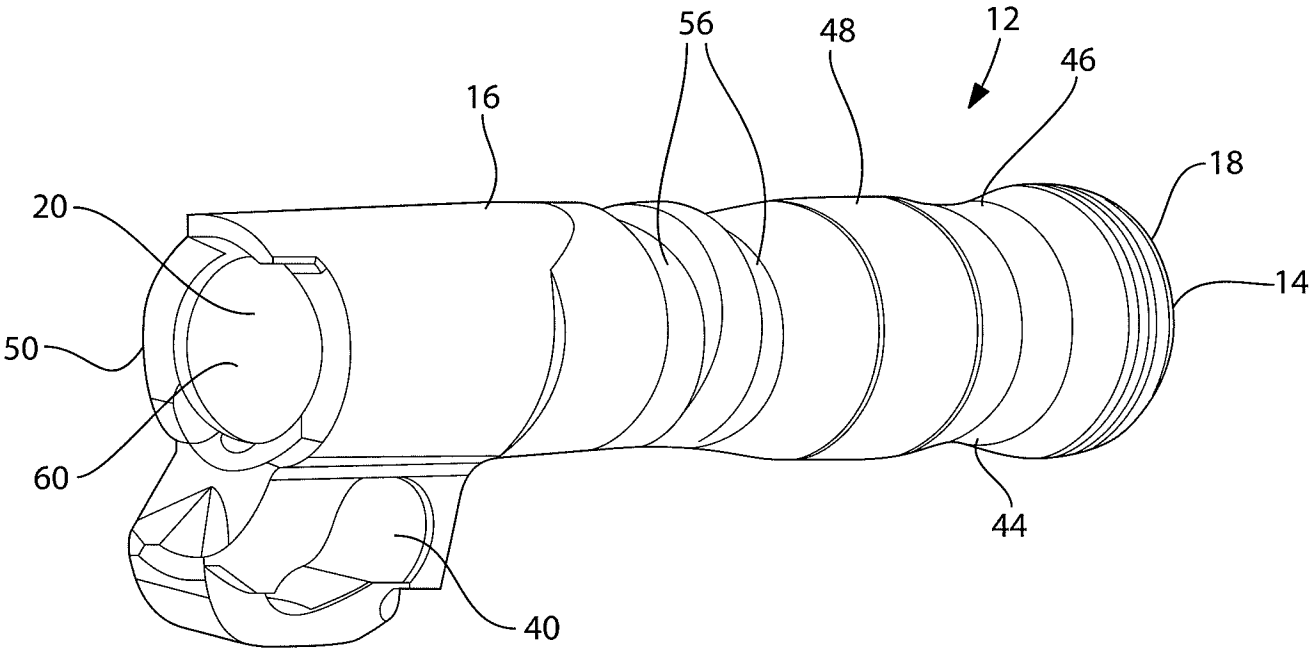
FIG. 4 is a right, side isometric view of the barrel of FIG. 2.

The invention will be illustrated in more detail with reference to the following embodiments, but it should be understood that the present invention is not deemed to be limited thereto. Referring now to the drawings, wherein like reference numbers refer to like elements throughout the several views, there is shown in FIG. 1 a semi-automatic pistol 10 having a barrel 12 with synchronized cams in accordance with a preferred embodiment of the present invention. The barrel 12 can best be seen in FIGS. 2-4. The barrel 12 has a central bore 14, an outside surface 16, a front end 18 and a chamber end 20. As can be seen in FIGS. 1 and 5-10, the semiautomatic pistol 10 includes a frame 22, a slide 24, a firing pin assembly 26, a trigger 28 and other elements common to semiautomatic pistols. The pistol 10 has a firing sequence typical to semi-automatic pistols and, therefore, will not be described in detail here. The slide 24 slides on rails that provide for linear motion of the slide 24 along the frame 22 during a firing sequence. The slide 24 has a forward end 30 and a block end 32.

In accordance with the present invention the barrel 12 is caused by elements of the frame 22 and slide 24 to follow a unique movement during a firing sequence to provide improved feeding and extraction of ammunition, and avoidance of jamming. Specifically, the forward end 30 of the slide 24 has an upper cam follower surface 34 on an inside surface 36 adjacent to the barrel 12. Additionally, the forward end 30 of the slide 24 has a lower cam follower surface 38 on an inside surface 36 adjacent to the barrel 12. The barrel 12 preferably has three cam surfaces. First, the barrel 12 has a ramp cam surface 40 adjacent to the chamber end 20 of the barrel 12 to effect locking and unlocking of the barrel 12 relative to the slide 24 during a firing sequence. Second, the barrel 12 has a bottom cam surface 42 on its bottom side 44. Third, the barrel has a top cam surface 46 on its top side 48. The bottom cam surface 42 and the top cam surface 46 are each on the outside surface of the barrel 12 and extend from the front end 18 toward the chamber end 20 of the barrel 12. The bottom cam surface 42 and the top cam surface 46 each have an undulating surface, as can be seen in FIGS. 2-10 to cause oscillation of the barrel 12 while the slide 24 moves from a battery position (see FIG. 5) to a fully retracted position (see FIG. 9) and back to the battery position during a firing sequence of the pistol. FIGS. 5-10 depict this movement of the barrel 12 during various instances in the firing sequence, as will be described in more detail below.

Figure 5:
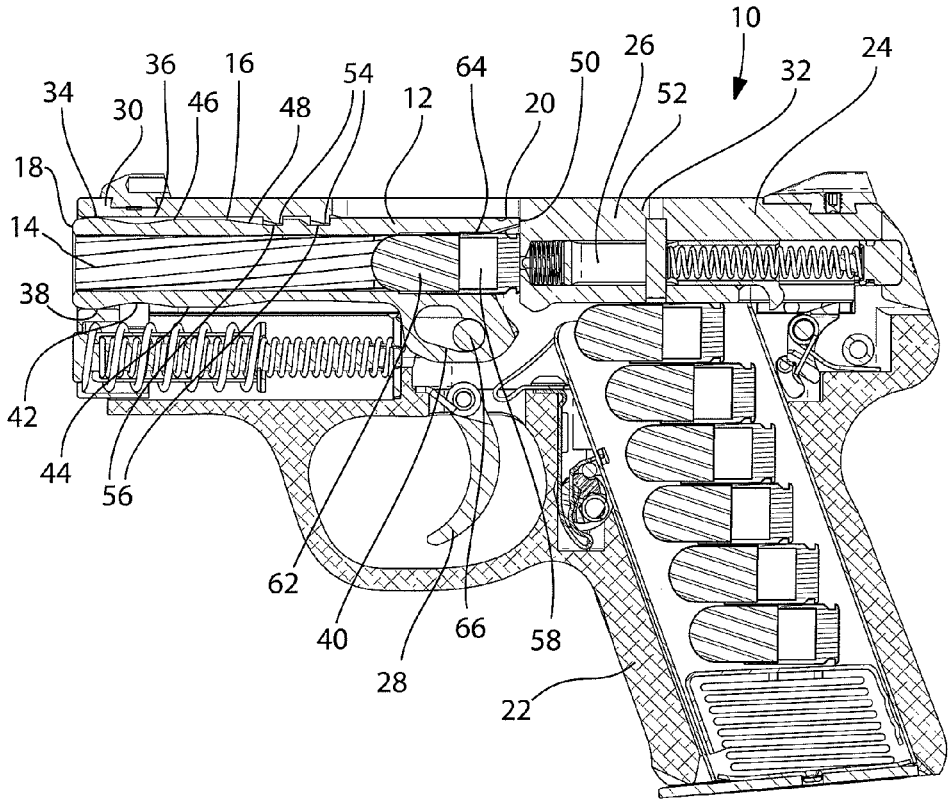
FIG. 5 is a cross-sectional view of the pistol having a barrel with synchronized cams of FIG. 1, taken substantially along lines I-I of FIG. 1, shown in a battery position.

FIG. 5 depicts a cross-sectional view of the pistol 10 in battery (i.e., firing) position. As can be seen, the cartridge 58 is in the chamber 60 of the barrel 12, the breech face end 50 of the barrel 12 is abutted against the slide block 52, and protuberances 54 on the slide are engaged with mating grooves 56 on the barrel 12 to secure the barrel 12 to the slide 24. Ramp cam follower 66 on the frame 22 (a pin integral to frame 22) is stationary at the right side of the ramp cam surface 40 on the bottom of the barrel 12.

Figure 6:
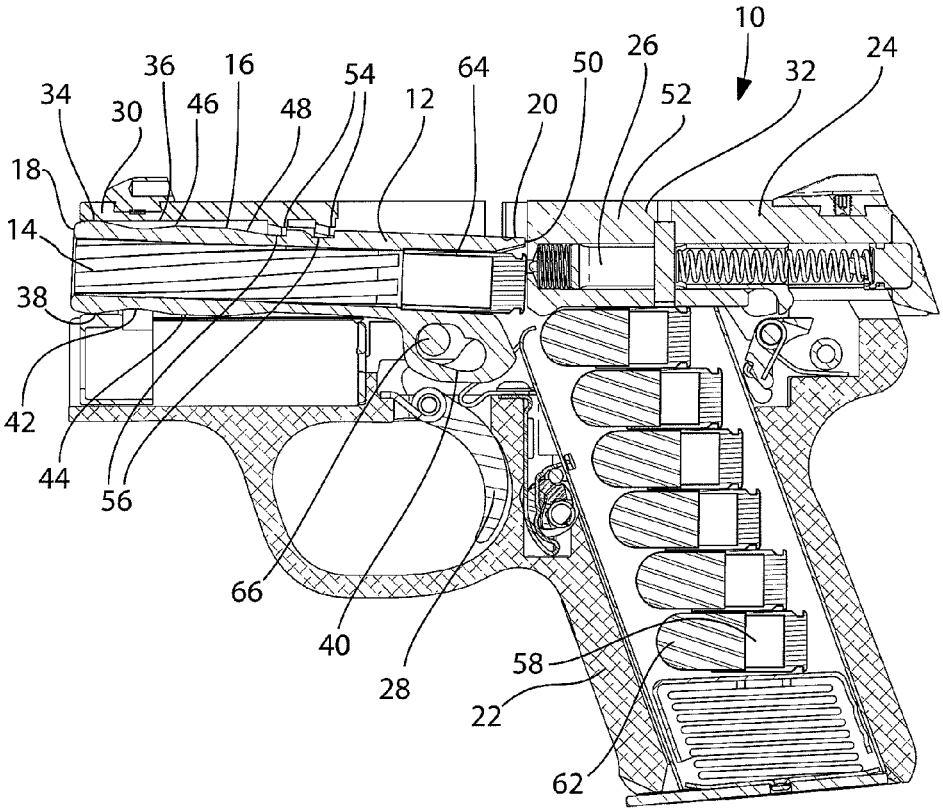
FIG. 6 is a cross-sectional view of the pistol having a barrel with synchronized cams of FIG. 1, taken substantially along lines I-I of FIG. 1, shown in an unlocked position with the slide partially retracted as it moves rearward.
Figure 11:
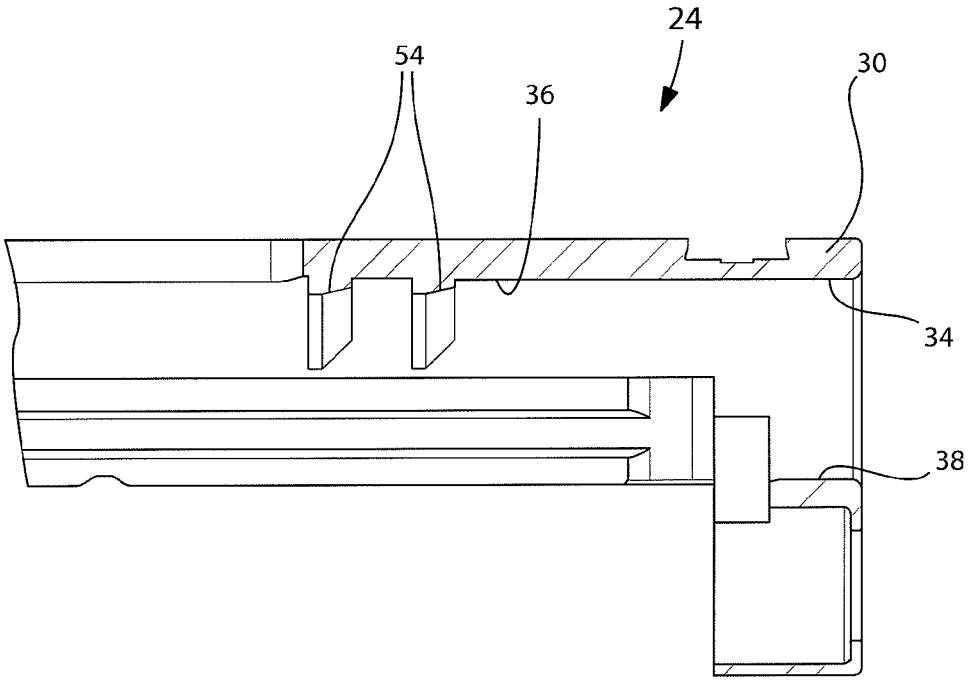
FIG. 11 is a partial cross sectional view of the slide, taken along lines II-II of FIG. 1.

FIG. 6 is a cross-sectional view of the pistol 10 immediately subsequent to firing, shown in an unlocked position with the slide partially retracted as it moves rearward. Here, comparing FIG. 5 to FIG. 6, movement of the trigger 28 of the pistol to a firing position causes the slide 24 to begin is rearward travel during a firing sequence such that the ramp cam surface 40 of the barrel 12 moves against the ramp cam follower 66 on the frame 22 to cause the front end 18 of the barrel to move upward and the chamber end 20 of the barrel 12 to move downward relative to the frame 22 to release the barrel 12 from fixed engagement with the slide 24 to allow the slide 24 to begin movement to a retracted position. The ramp cam follower 66 is now located on the left side of the ramp cam surface 40 on the bottom of the barrel 12 (i.e., the barrel 12 has moved relative to the ramp cam follower 66 on the frame). As can be seen, the bullet 62 has left the casing 64 of the cartridge 58 in the chamber 60 of the barrel 12, the breech face end 50 of the barrel 12 has moved slightly downward off the block 52, and protuberances 54 on the slide are disengaged with mating grooves 56 on the barrel 12. The slide 24 has begun its rearward travel. The upper cam follower surface 34 begins to follow the top cam surface 46 of the barrel 12, and lower cam follower surface 38 begins to follow the bottom cam surface 44 of the barrel 12, causing the barrel 12 to begin its undulating movement during a firing sequence. The top cam surface 46 and the bottom cam surface 44 may act on their respective cam follower surfaces 34, 38 simultaneously at certain points of the travel or the top cam surface 46 and the bottom cam surface 44 may act independently during any specific point of the firing sequence. That is, all cam surfaces and mating cam follower surfaces need not be in contact with one another at all points of the firing sequence. See the slide 24 as shown in FIG. 11.

Figure 7:
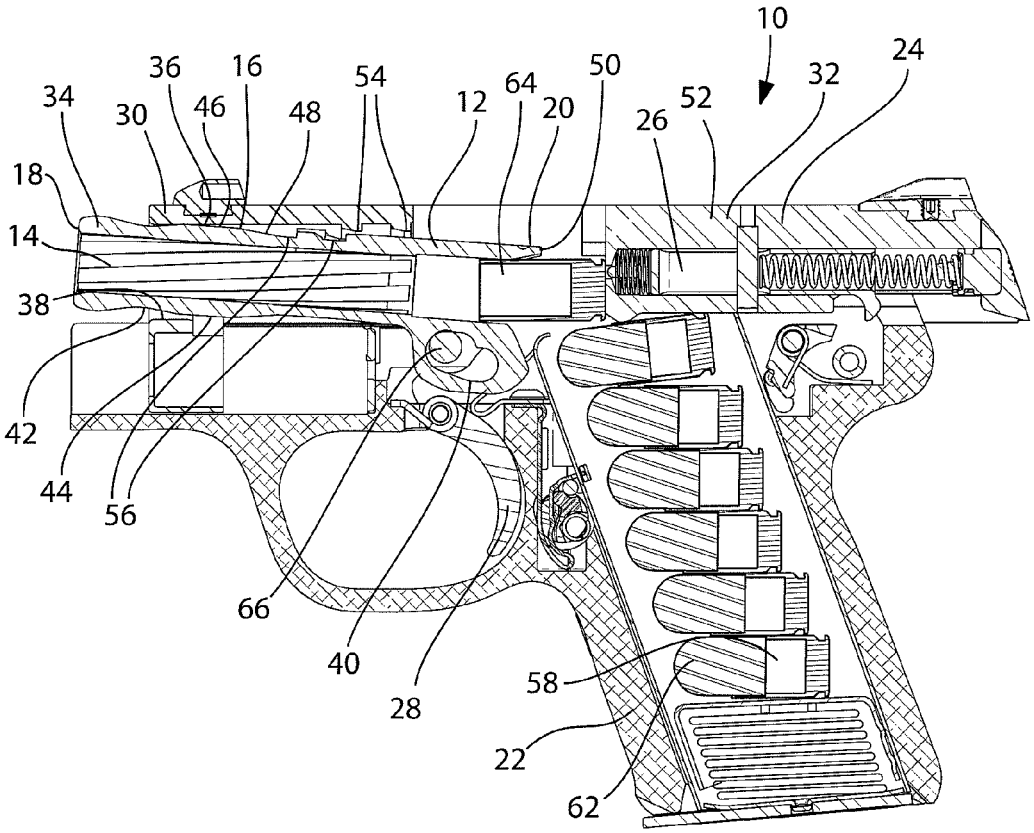
FIG. 7 is a cross-sectional view of the pistol having a barrel with synchronized cams of FIG. 1, taken substantially along lines I-I of FIG. 1, shown in a case pre-ejected position with the slide partially retracted as it moves rearward.
Figure 8:
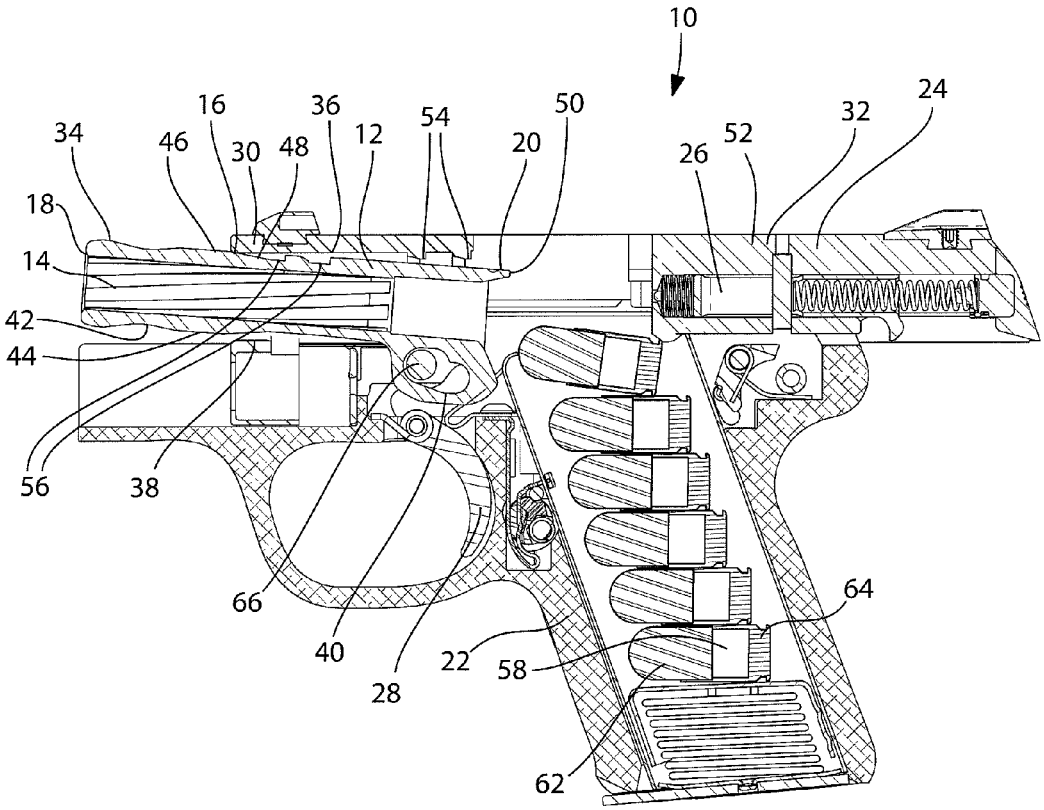
FIG. 8 is a cross-sectional view of the pistol having a barrel with synchronized cams of FIG. 1, taken substantially along lines I-I of FIG. 1, shown in a case ejected position, with the slide partially retracted as it moves rearward.
Figure 9:
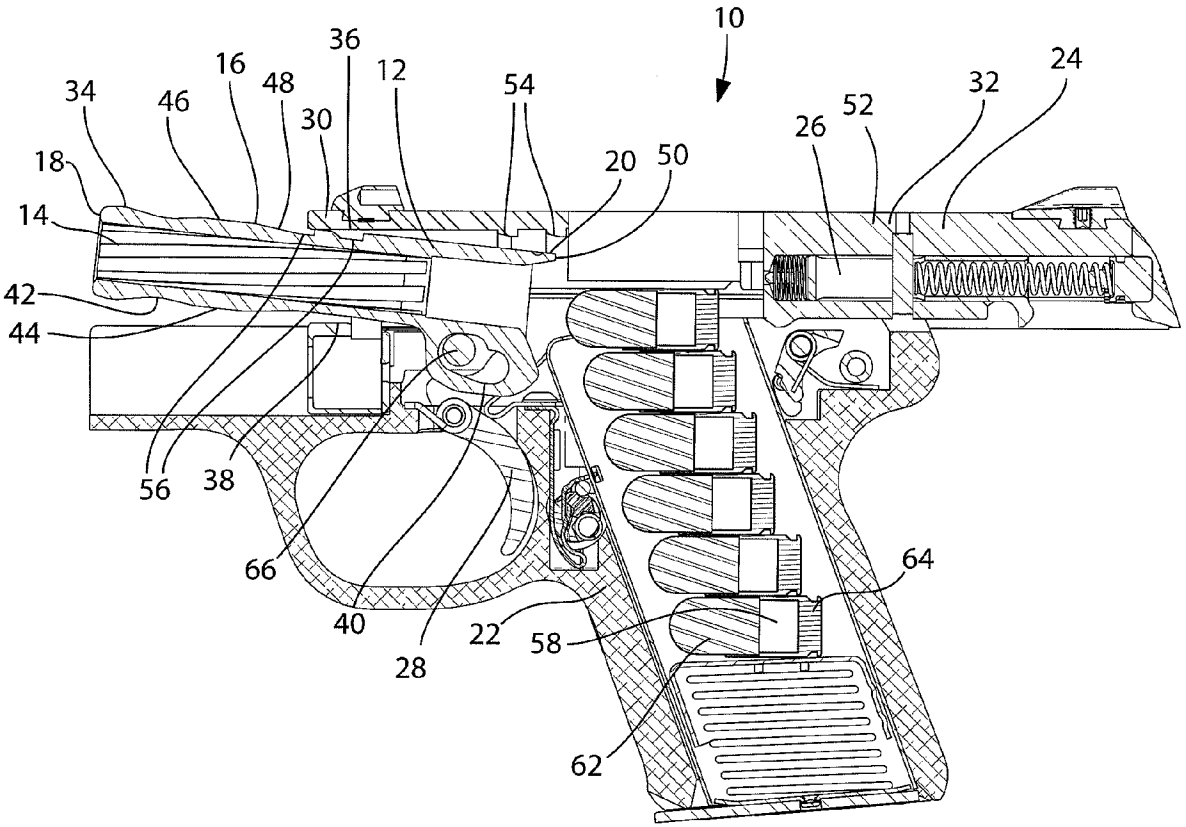
FIG. 9 is a cross-sectional view of the pistol having a barrel with synchronized cams of FIG. 1, taken substantially along lines I-I of FIG. 1, shown in an open rear position with the slide fully retracted.
Figure 10:
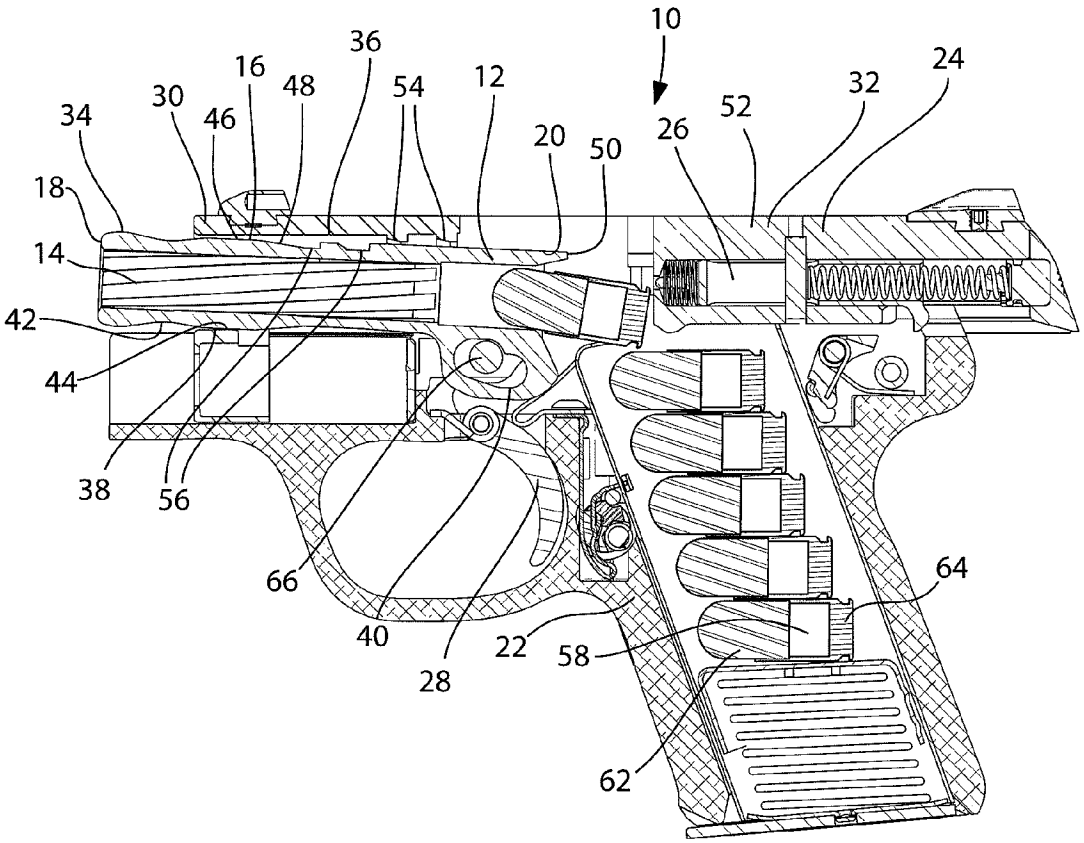
FIG. 10 is a cross-sectional view of the pistol having a barrel with synchronized cams of FIG. 1, taken substantially along lines I-I of FIG. 1, shown in a feed-in position, with the slide in a partially retracted position, as it moves forward.

FIG. 7 is a cross-sectional view of the pistol 10 shown in a case pre-ejected position with the slide 24 further retracted from the frame 22 as compared with FIG. 6, as it moves rearward during a firing sequence. FIG. 8 is a cross-sectional view of the pistol 10 shown in a case ejected position, with the slide further retracted (but not fully retracted) as it moves rearward. FIG. 9 is a cross-sectional view of the pistol 10 shown in an open rear position with the slide fully retracted. Finally, FIG. 10 is a cross-sectional view of the pistol 10 shown in a feed-in position, with the slide in a partially retracted position, as it moves forward during a firing sequence. As can be seen when comparing these figures to one another and to FIGS. 5 and 6, the upper cam follower surface 34 generally follows the top cam surface 46 of the barrel 12, and lower cam follower surface 38 generally follows the bottom cam surface 44 of the barrel 12, causing the barrel 12 to oscillate during a firing sequence. Again, during any particular point in the firing sequence, the top cam surface 46 may not necessarily be in contact with the upper cam follower surface 34 and the bottom cam surface 44 may not necessarily be in contact with the lower cam follower surface 38.

While the invention has been described in detail and with reference to specific examples thereof, it will be apparent to one skilled in the art that various changes and modifications can be made therein without departing from the spirit and scope thereof.

What is claimed is:

1. A barrel for a semi-automatic pistol, comprising a bore, an outside surface, a front end and a chamber end, the barrel comprising a bottom cam surface and a top cam surface, the bottom cam surface and the top cam surface each on the outside surface of the barrel and extending from the front end toward the chamber end of the barrel to one of a pair of mating grooves disposed on the barrel, said mating grooves for securing the barrel to a slide of the pistol, the bottom cam surface and the top cam surface each having an undulating surface relative to a longitudinal axis of the barrel, each undulating surface beginning at the front end, curving outwardly relative to the longitudinal axis of the barrel, then curving inwardly relative to the longitudinal axis of the barrel, then curving outwardly relative to the longitudinal axis of the barrel, and then curving inwardly relative to the longitudinal axis of the barrel to cause oscillation of the barrel while the slide moves from a battery position to a fully retracted position and back to the battery position during a firing sequence.

* * * * *